US010276987B2

(12) United States Patent
Miyazawa et al.

(10) Patent No.: US 10,276,987 B2
(45) Date of Patent: Apr. 30, 2019

(54) SHIELDED CONNECTOR STRUCTURE INCLUDING SHIELDED WIRE FOR CONNECTING A DEVICE, A SHIELDED CONNECTOR, AND A METAL MEMBER

(71) Applicant: YAZAKI CORPORATION, Tokyo (JP)

(72) Inventors: Yuki Miyazawa, Shizuoka (JP); Kenichi Okamoto, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 15/946,624

(22) Filed: Apr. 5, 2018

(65) Prior Publication Data

US 2018/0351304 A1 Dec. 6, 2018

(30) Foreign Application Priority Data

May 31, 2017 (JP) ..... 2017-107660

(51) Int. Cl.
*H01R 13/6592* (2011.01)
*H01R 13/6596* (2011.01)
(Continued)

(52) U.S. Cl.
CPC ..... *H01R 13/6592* (2013.01); *H01R 9/0518* (2013.01); *H01R 13/6596* (2013.01); *H01R 4/184* (2013.01); *H01R 4/34* (2013.01); *H01R 11/12* (2013.01); *H01R 12/596* (2013.01); *H01R 13/52* (2013.01); *H01R 13/5202* (2013.01); *H01R 13/5205* (2013.01); *H01R 13/5219* (2013.01); *H01R 13/5221* (2013.01); *H01R 13/6584* (2013.01); *H01R 13/74* (2013.01); *H01R 13/743* (2013.01)

(58) Field of Classification Search
CPC ..... H01R 12/596; H01R 13/5202; H01R 13/6584; H01R 13/743; H01R 13/5219; H01R 13/5221; H01R 13/52; H01R 13/5205; H01R 13/6592; H01R 13/74
USPC ..... 439/98, 648, 556, 559, 587, 607.42, 439/607.44, 546, 548
See application file for complete search history.

(56) References Cited

U.S. PATENT DOCUMENTS 6,280,208 B1 * 8/2001 Masuda ..... H01R 4/64 174/359

FOREIGN PATENT DOCUMENTS

JP 2000-294344 A 10/2000

* cited by examiner

*Primary Examiner* — Abdullah A Riyami
*Assistant Examiner* — Justin M Kratt
(74) *Attorney, Agent, or Firm* — Kenealy Vaidya LLP

(57) ABSTRACT

A shielded connector structure includes a shielded wire for connecting a device, a shielded connector, and a metal member provided on the device. The shielded connector includes a terminal fitting, a shield terminal, a housing, and a bolt for fixing the housing to the metal member. The metal member includes a circular insertion hole and a female screw portion. The circular insertion hole includes an inner circumferential projected portion and a cutout portion that divides a part of the inner circumferential projected portion. The housing includes a cylindrical housing main body and a fixing flange portion. The housing main body includes a main body insertion portion inserted into the circular insertion hole and a projection portion which protrudes from an outer circumferential surface of the main body insertion portion in conformity with a position of the inner circumferential projected portion.

4 Claims, 13 Drawing Sheets

(51) Int. Cl.

| | |
|---|---|
| ***H01R 9/05*** | (2006.01) |
| *H01R 4/18* | (2006.01) |
| *H01R 11/12* | (2006.01) |
| *H01R 13/52* | (2006.01) |
| *H01R 13/74* | (2006.01) |
| *H01R 13/6584* | (2011.01) |
| *H01R 12/59* | (2011.01) |
| *H01R 4/34* | (2006.01) |

SHIELDED CONNECTOR STRUCTURE INCLUDING SHIELDED WIRE FOR CONNECTING A DEVICE, A SHIELDED CONNECTOR, AND A METAL MEMBER

CROSS REFERENCE TO RELATED APPLICATIONS

This application is based on Japanese Patent Application (No. 2017-107660) filed on May 31, 2017, the contents of which are incorporated herein by reference.

BACKGROUND OF THE INVENTION

1. Field of the Invention

The present invention relates to a shielded connector structure including a shielded wire for connecting a device, a shielded connector provided on the shielded wire, and a metal member having a wall and provided in the device.

2. Description of the Related Art

In order to electrically connect high-voltage devices, which are mounted on a hybrid vehicle or an electric vehicle, to each other, a shielded wire or a shielded connector provided in the shielded wire are used. Here, when the above-described connection structure is referred to as a shielded connector structure, regarding the shielded connector structure, for example, a structure disclosed in JP-A-2000-294344 is generally known. Hereinafter, a brief description will be given with reference to FIGS. 11A to 13.

In FIGS. 11A to 13, a shield case (metal member) of the device is provided with a wall indicated by a reference numeral 101. In addition, a shielded wire indicated by a reference numeral 102 or a shielded connector indicated by a reference numeral 103 are used so as to be inserted through the wall 101. Furthermore, a reference numeral 104 indicates a shielded connector structure that serves as a structure for the connections.

On the wall 101, a circular insertion hole 105 and a female screw portion 106 are formed. One female screw portion 106 is formed to be disposed in the vicinity of the circular insertion hole 105. The shielded wire 102 includes a conductor 107, an insulator 108, a shield member 109 (braid), and a sheath 110.

The shielded connector 103 includes: a terminal fitting 111 which is connected to the conductor 107 of the shielded wire 102; a shield terminal 112 which is connected to the shield member 109 of the shielded wire 102 and comes into contact with the wall 101 of the shield case (metal member); a housing 113 into which the shielded wire 102 is inserted; and a bolt 114 for fixing the housing 113 to the wall 101. In addition, the shielded connector 103 includes a packing 115, a rubber plug 116, a rear holder 117, and the like.

The housing 113 of the shielded connector 103 includes: a housing main body 118 in which a part is inserted into the circular insertion hole 105; and an annular flange portion 119 and a fixing flange portion 120 which are integrated with the housing main body 118. In the housing main body 118, the part inserted into the circular insertion hole 105 is formed in a cylindrical shape. One bolt insertion hole 121 is formed in the fixing flange portion 120.

In the shielded connector 103 provided in the shielded wire 102, a part of the housing main body 115 is inserted into the circular insertion hole 105, and after this, the fixing flange portion 120 is fixed to the wall 101 by tightening the bolt 114. Furthermore, in the shielded connector 103, one-point fixing structure is adopted from the viewpoint of workability and size (the reason is that when the number of the fixing flange portion 120 having the bolt insertion hole 120, the bolt 114, and the female screw portion 106 of the wall 101 increases, the number of fastening points increases and the workability deteriorates, and as the number of fastening points increases, the size also increases).

In the above-described related art, since the one-point fixing structure is adopted, there is a concern that a side opposite to a fastening point due to the tightening of the bolt 114, that is, a location indicated by an arrow W, becomes weaker against the external force. In a case where strong impact is applied to the location indicated by the arrow W for some reasons, it is considered that a gap is generated between the housing 113 and the wall 101. The gap leads to deterioration of shielding performance.

SUMMARY OF THE INVENTION

The present invention has been made in consideration of the above-described problem, and an object thereof is to provide and a shielded connector structure capable of preventing deterioration of shielding performance.

To achieve the above objection, following configurations (1) and (2) of the shielded connector structure are provided.

(1) There is provided a shielded connector structure comprising:

a shielded wire for connecting a device;

a shielded connector provided on the shielded wire; and a metal member provided on the device, wherein the shielded connector includes a terminal fitting which is connected to a conductor of the shielded wire, a shield terminal which is connected to a shield member of the shielded wire and directly or indirectly comes into contact with the metal member, a housing into which the shielded wire is inserted, and a bolt for fixing the housing to the metal member;

wherein the metal member includes a circular insertion hole and a female screw portion which is disposed in a vicinity of the circular insertion hole;

wherein the circular insertion hole includes an inner circumferential projected portion extending in an inner circumferential direction from an inner surface of the circular insertion hole and a cutout portion that divides a part of the inner circumferential projected portion;

wherein the housing includes a cylindrical housing main body and a fixing flange portion having a bolt insertion hole and which is integrated with the housing main body;

wherein the housing main body includes a main body insertion portion configured to be inserted into the circular insertion hole and a projection portion which protrudes from an outer circumferential surface of the main body insertion portion in conformity with a position of the inner circumferential projected portion in the circular insertion hole;

wherein the projection portion is disposed so as to be aligned with a first axis that links a main body center of the housing main body and a hole center of the bolt insertion hole, and is disposed so that the main body center is arranged between the bolt insertion hole and the projection portion; and wherein the cutout portion is disposed so as to be aligned with a third axis intersecting with a second axis that links a center of the circular insertion hole and a center of the female screw portion.

According to the shielded connector structure of the configuration (1), even when strong impact is applied to the side opposite to the fastening point for some reasons, since the projection portion of the housing of the shielded connector is engaged with the inner circumferential projected portion of the metal member in the device, it is possible to achieve an excellent fixed state of the shielded connector to the device. In other words, it is possible to prevent generation of a gap on the side opposite to the fastening point. In addition, according to the aspect, since the main body insertion portion is inserted into the circular insertion hole by aligning the position of the projection portion with the position of the cutout portion, and then the projection portion is engaged with the inner circumferential projected portion only by rotating the housing, it is also possible to ensure excellent workability.

(2) For example, the third axis intersects with the second axis at an acute angle.

According to the shielded connector structure of the configuration (2), it is possible to reduce an amount of rotation of the housing, thereby contributing to ensuring excellent workability.

(3) For example, the inner circumferential projected portion is formed in a C-shaped rib in a state where the circular insertion hole is viewed from a front side.

(4) For example, a close contact surface and an outer circumferential projected portion are formed on the outer circumferential surface of the main body insertion portion, a packing is attached on the close contact surface, and the outer circumferential projected portion positions the packing.

According to the shielded connector structure of the invention, even when strong impact is applied to the side opposite to the fastening point for some reasons, a gap is not generated. Therefore, it is possible to prevent the deterioration of the shielding performance.

BRIEF DESCRIPTION OF THE DRAWINGS

FIGS. 1A and 1B are views illustrating one embodiment of a shielded connector structure of the invention, wherein FIG. 1A is a perspective view and FIG. 1B is a front view of FIG. 1A;

FIGS. 11A to 11D are views illustrating a shielded connector structure of the related art, wherein FIG. 11A is a perspective view, FIG. 11B is a perspective view of a housing, FIG. 11C is a perspective view of a wall, and FIG. 11D is a front view of the wall;

DETAILED DESCRIPTION OF THE EXEMPLARY EMBODIMENTS

The shielded connector structure has a part at which the circular insertion hole of the device and the housing of the shielded connector are engaged with each other on the side opposite to the fastening point by one-point fixing of the bolt. Specifically, the circular insertion hole includes an inner circumferential projected portion that has a projected shape and extends in the inner circumferential direction, and a cutout portion having a shape that divides a part of the inner circumferential projected portion, and the housing includes a projection portion which moves from the position of the cutout portion and engages with the inner circumferential projected portion by being rotated.

Embodiment

Figure 1B:
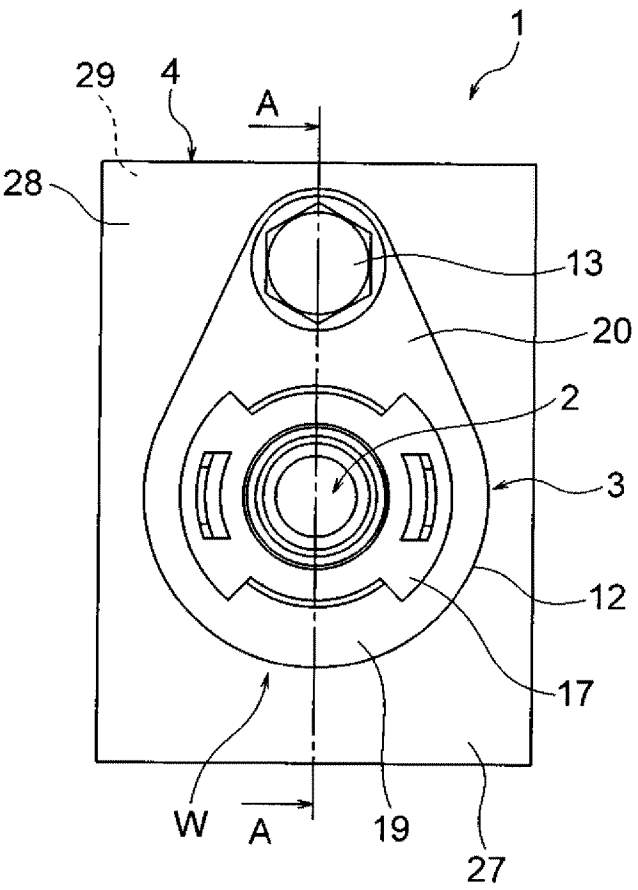
Figure 1A:
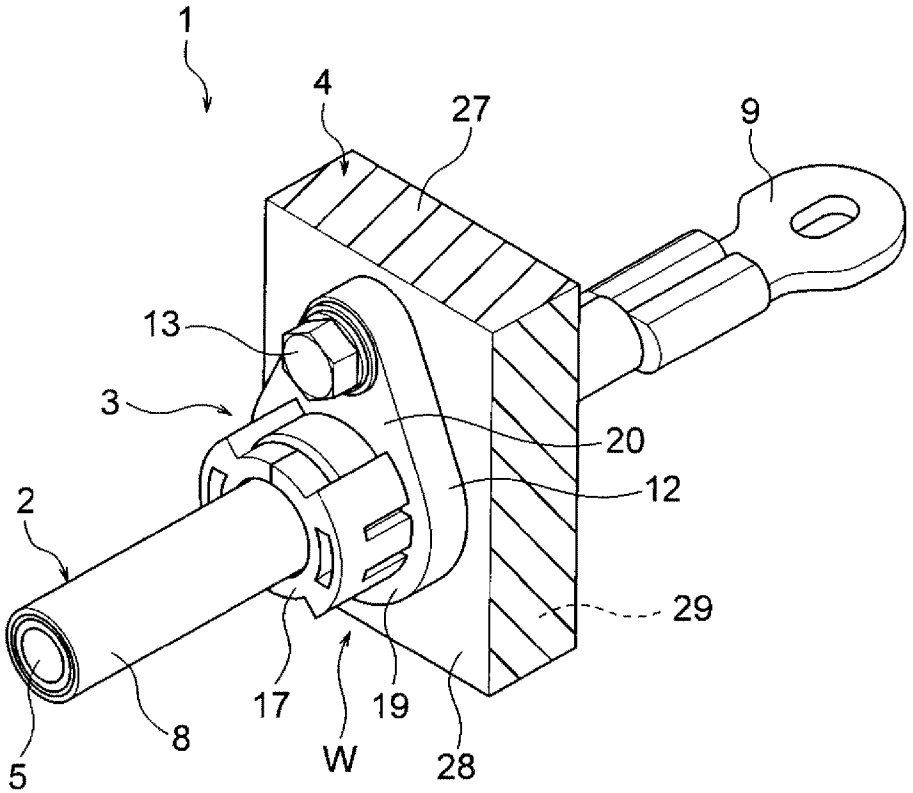
Figure 2:
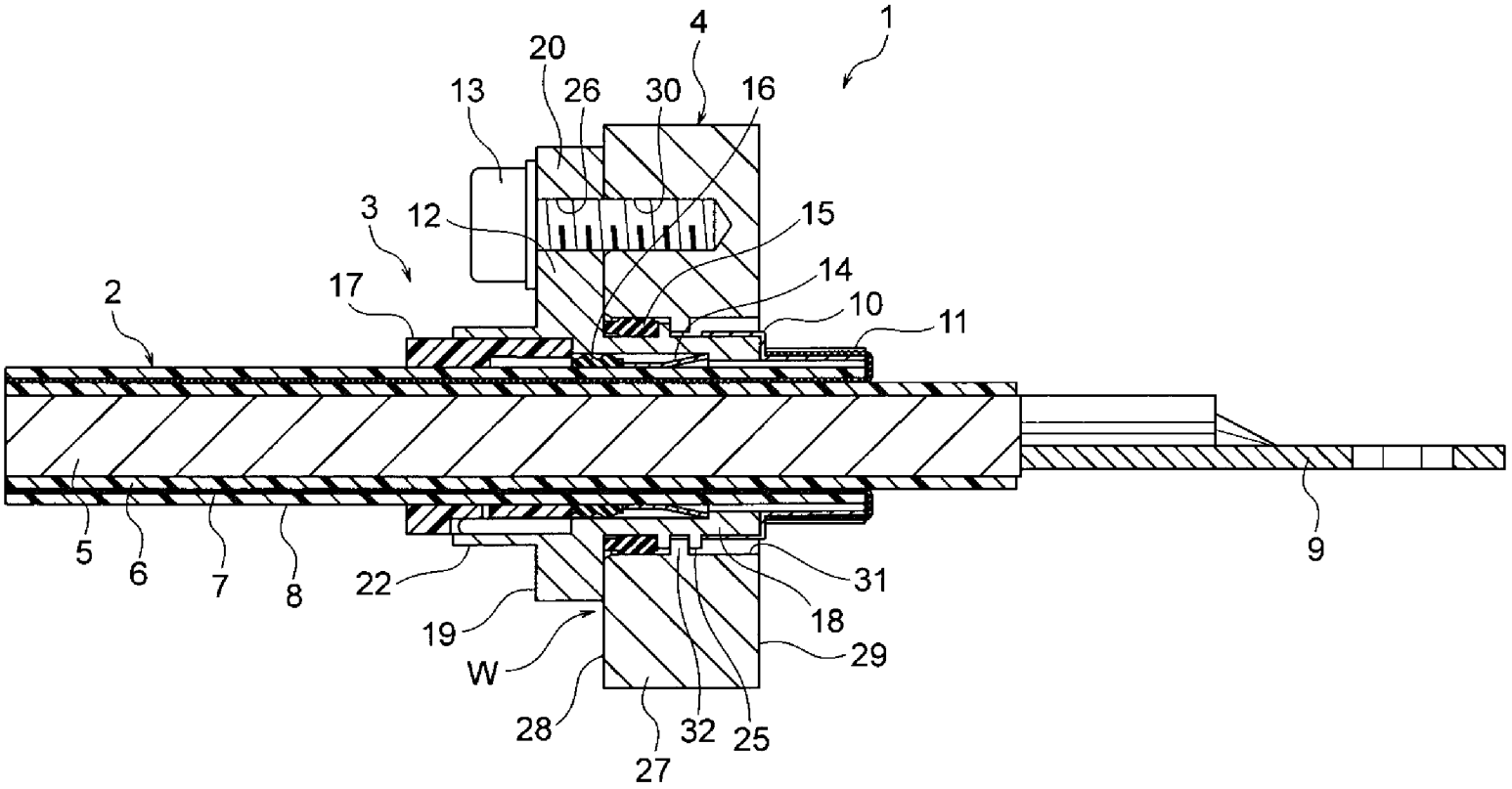
FIG. 2 is a sectional view taken along line A-A in FIG. 1B.
Figure 3:
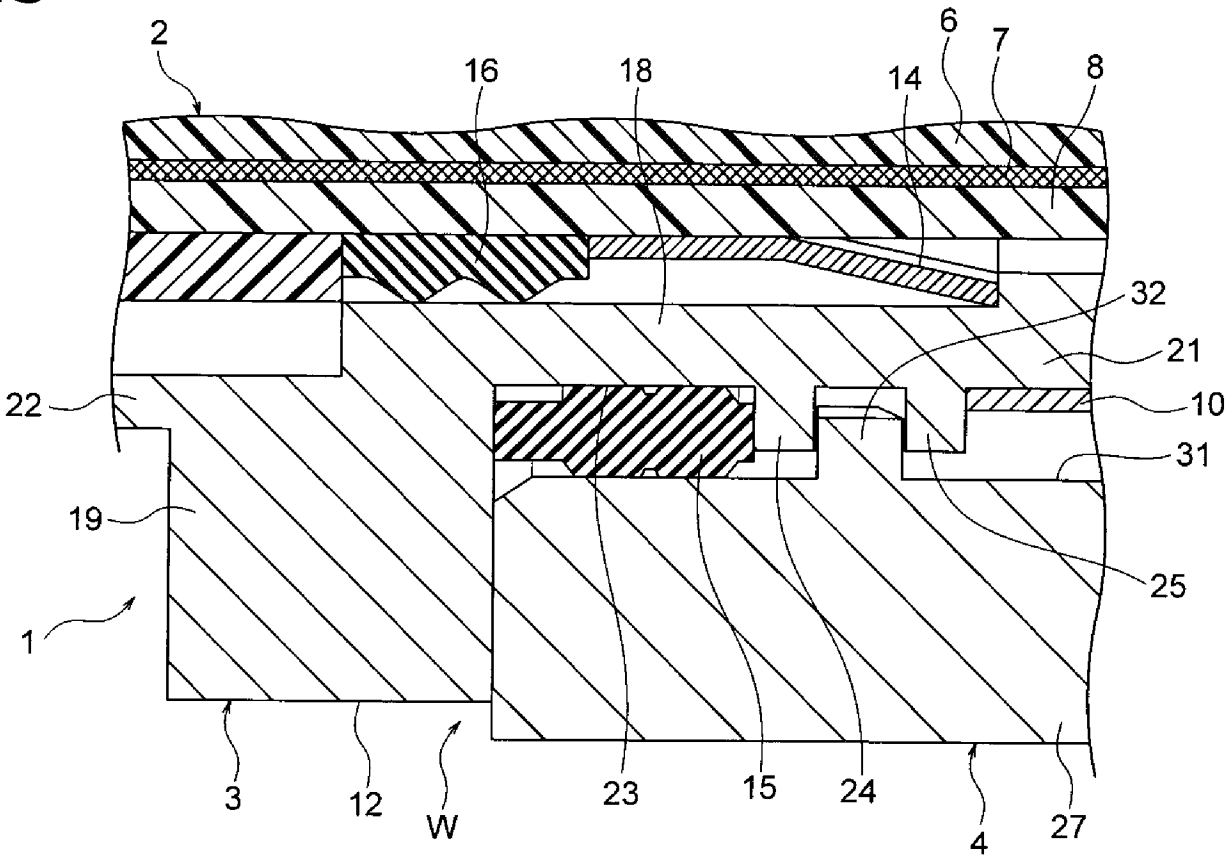
FIG. 3 is an enlarged view of a main portion of FIG. 2.
Figure 4B:
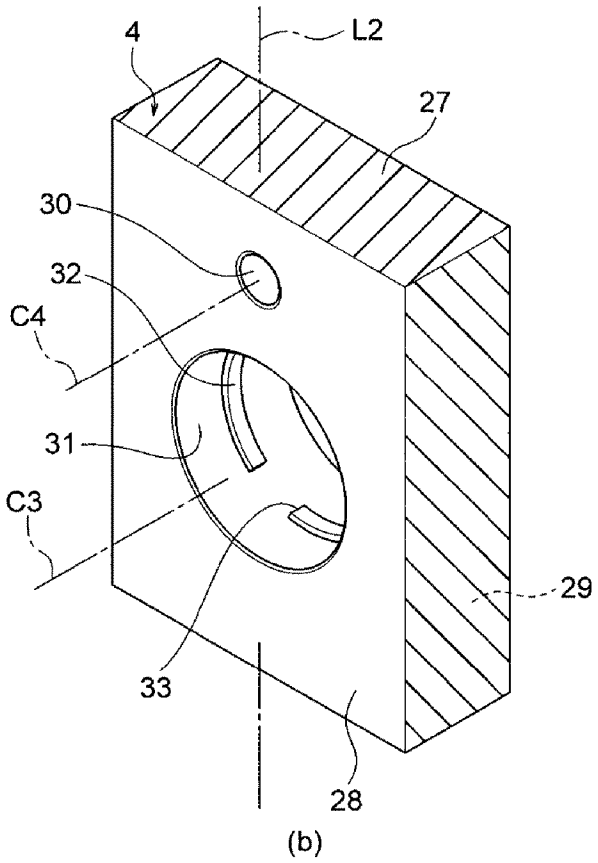
FIG. 4B is a perspective view of a wall.
Figure 4A:
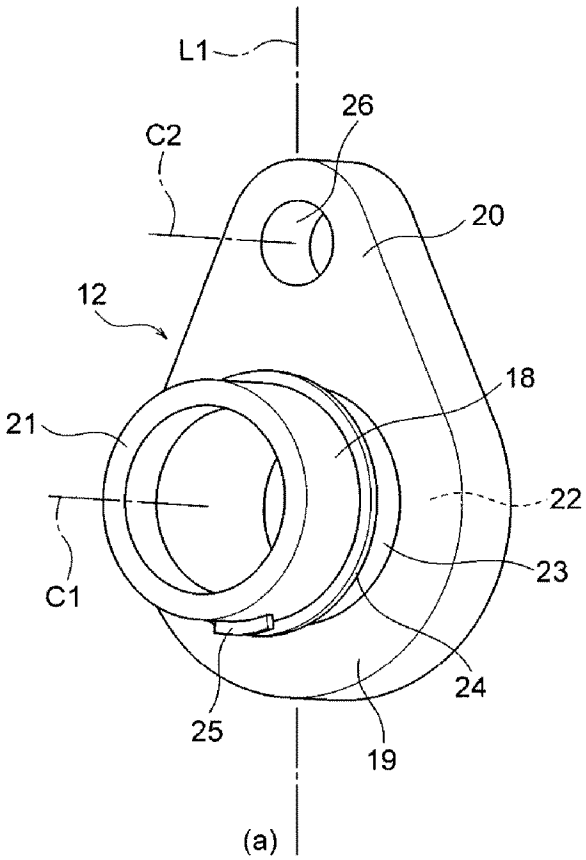
FIG. 4A is a perspective view of a housing.
Figure 5B:
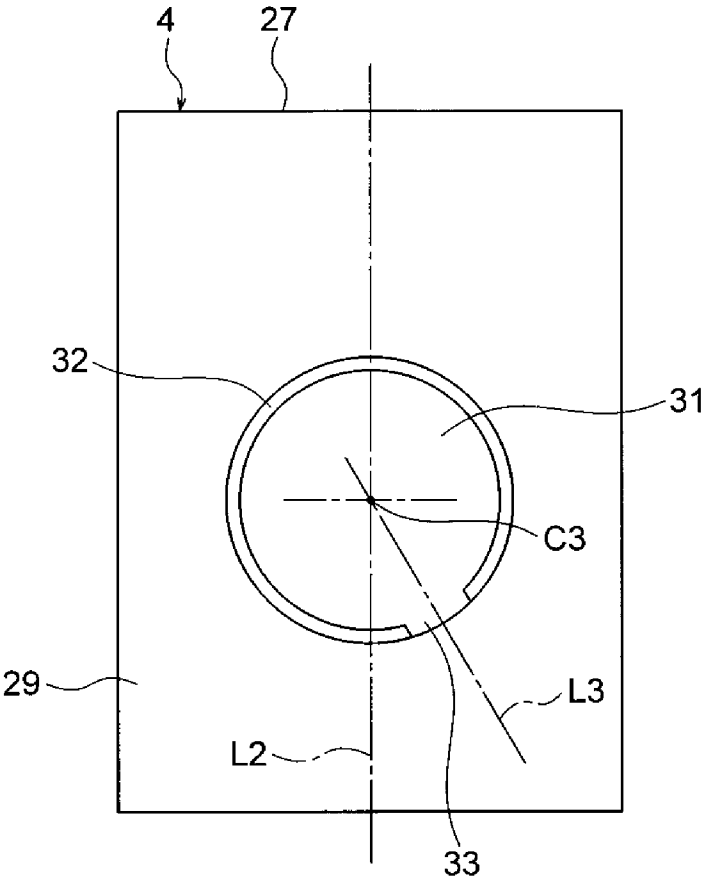
FIG. 5B is a rear view of the wall.
Figure 5A:
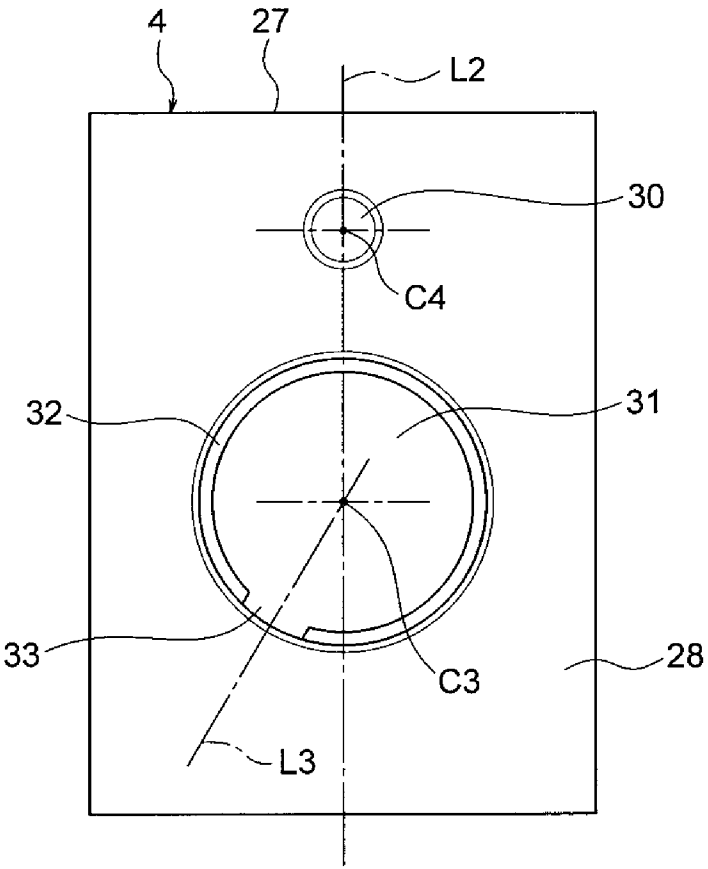
FIG. 5A is a front view of the wall.
Figure 6:
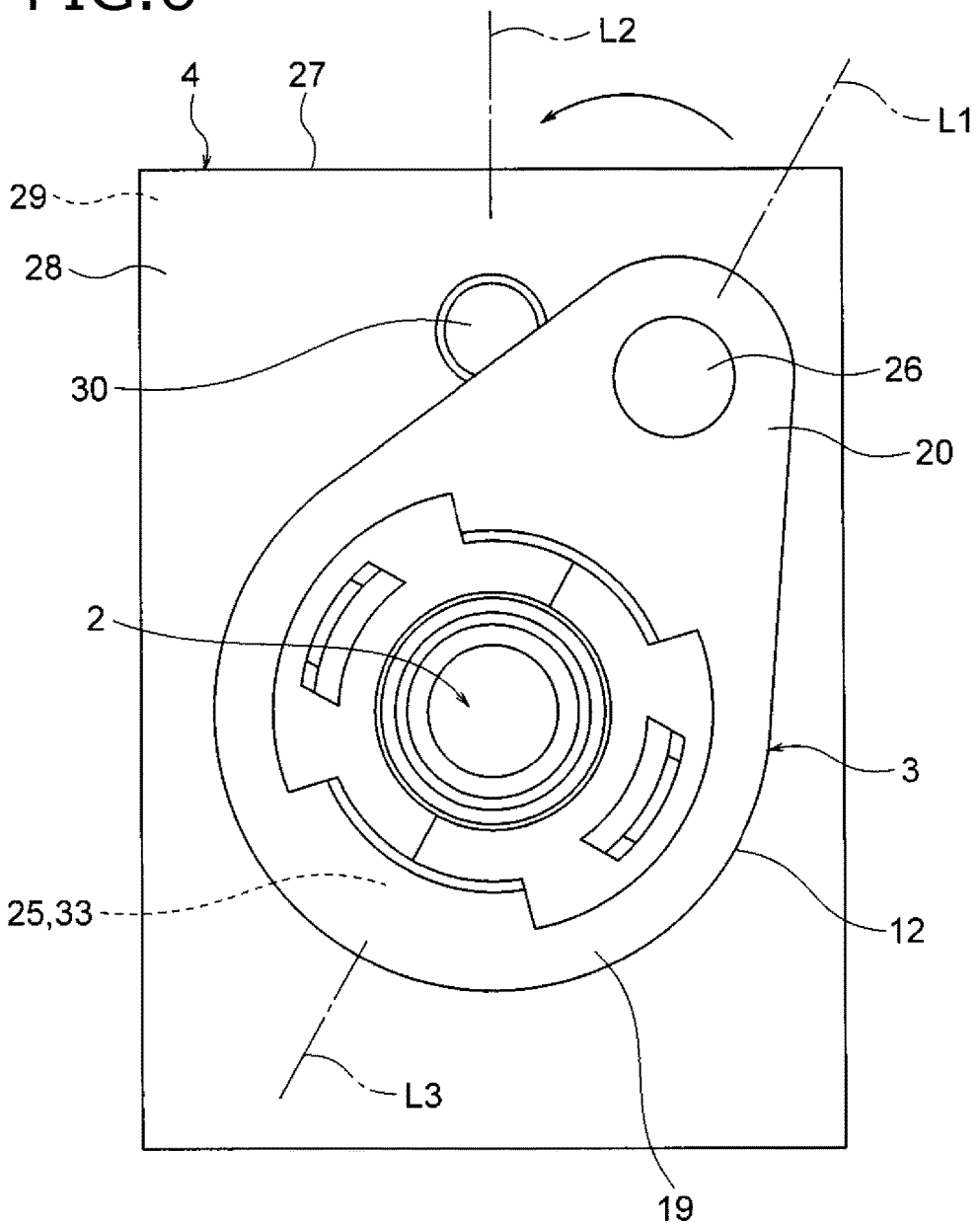
FIG. 6 is a front view illustrating a state before the housing is rotated by inserting a main body insertion portion into a circular insertion hole.
Figure 7:
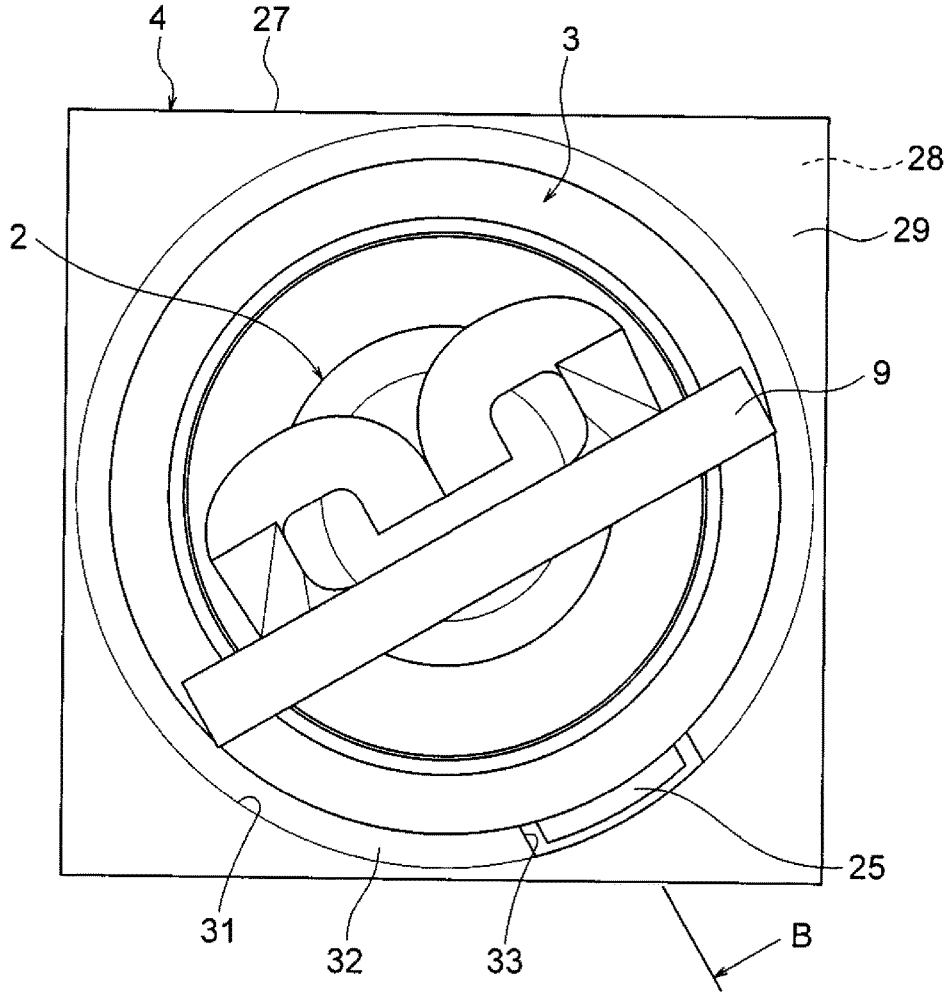
FIG. 7 is a rear view illustrating a state before the housing is rotated by inserting the main body insertion portion into the circular insertion hole (view illustrating a rear side of FIG. 6)
Figure 8:
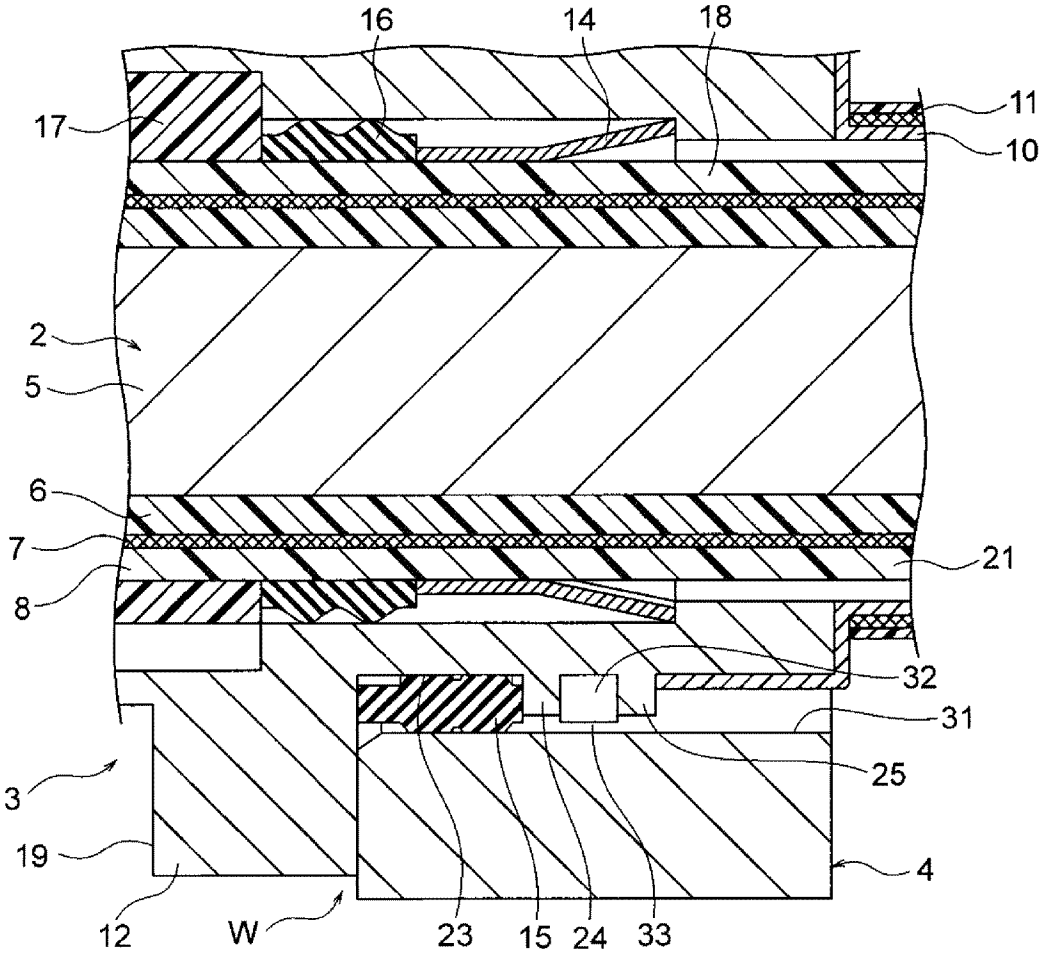
FIG. 8 is a sectional view taken along line B-B in FIG. 7.
Figure 9:
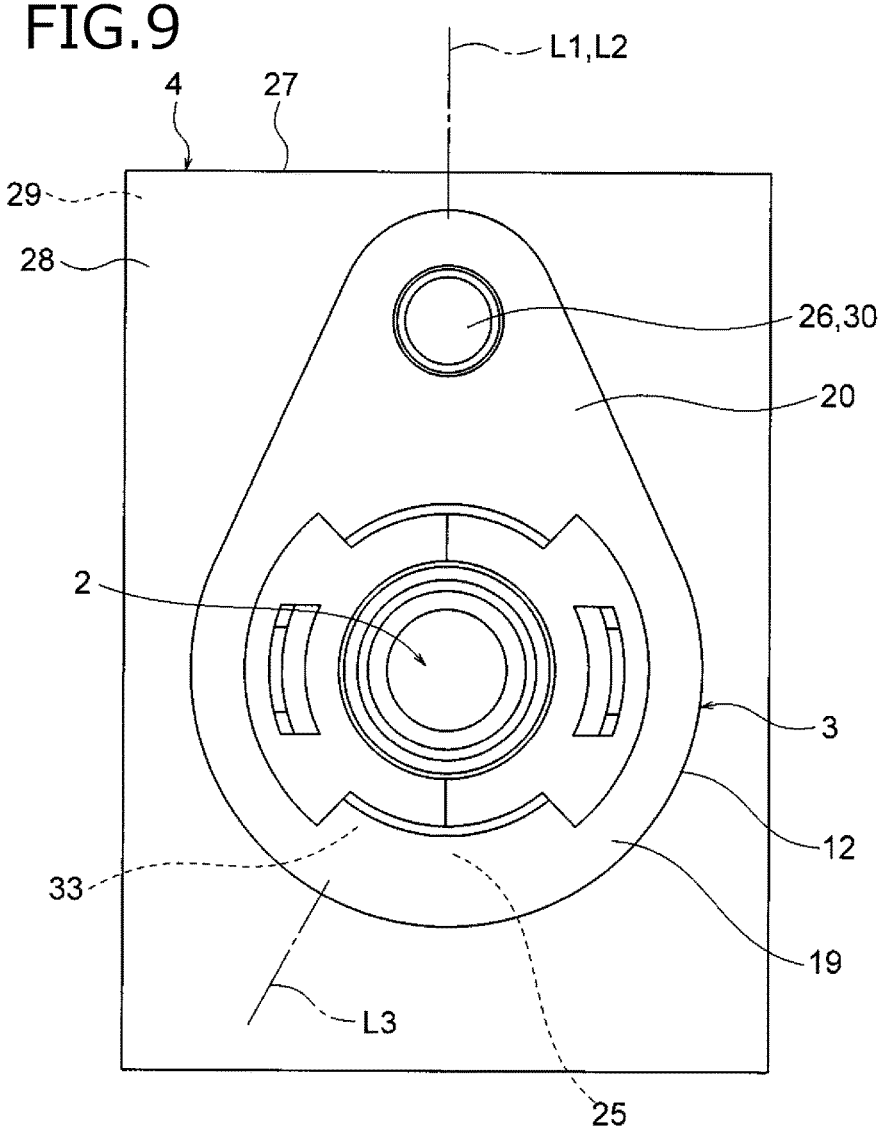
FIG. 9 is a front view illustrating a state after the housing is rotated by inserting the main body insertion portion into the circular insertion hole.
Figure 10:
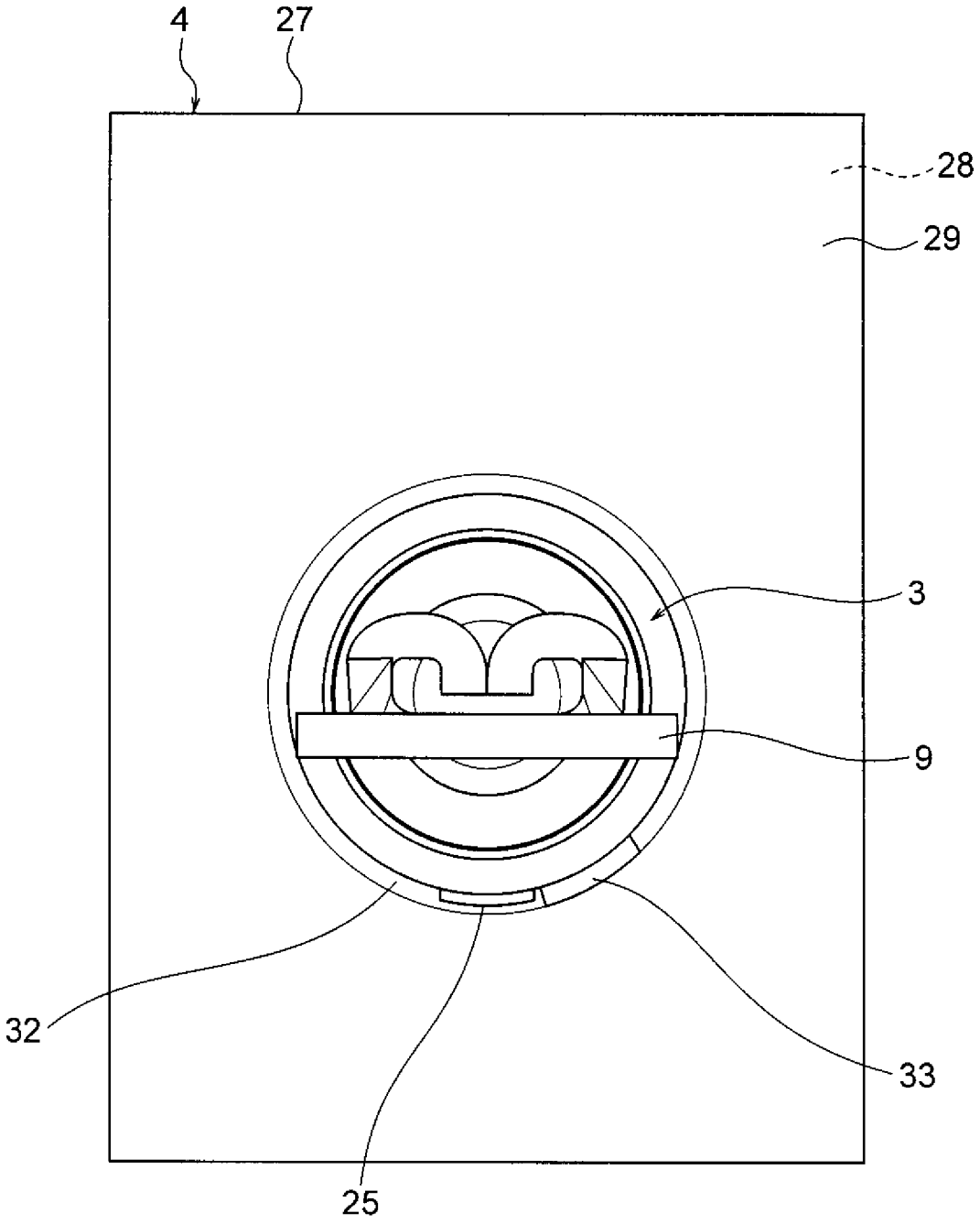
FIG. 10 is a rear view illustrating a state after the housing is rotated by inserting the main body insertion portion into the circular insertion hole (view illustrating a rear side of FIG. 9)
Figure 11A:
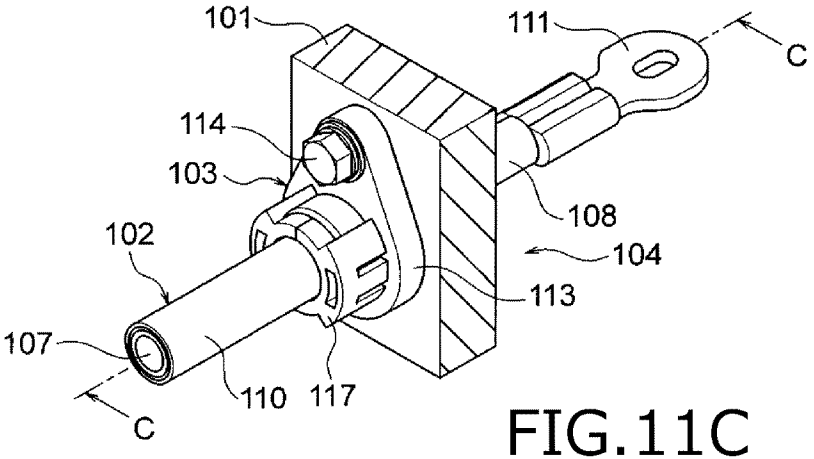
Figure 11C:
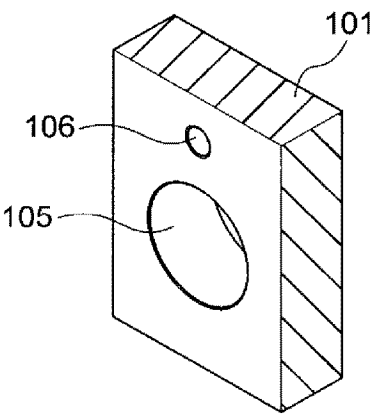
Figure 11B:
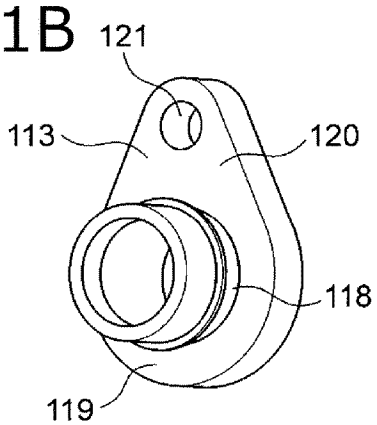
Figure 11D:
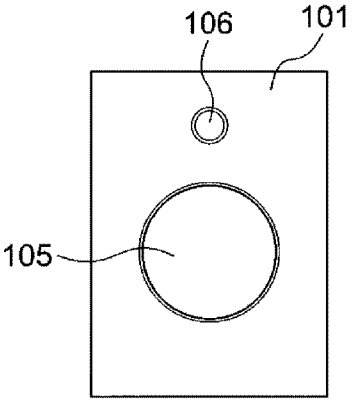

Hereinafter, embodiments will be described with reference to the drawings. FIGS. 1A and 1B are views illustrating one embodiment of a shielded connector structure of the invention, wherein FIG. 1A is a perspective view and FIG. 1B is a front view of FIG. 1A. In addition, FIG. 2 is a sectional view taken along line A-A of FIG. 1B, and FIG. 3 is an enlarged view of a main portion of FIG. 2. In addition, FIG. 4A is a perspective view of a housing, and FIG. 4B is a perspective view of a wall. Further, FIG. 5A is a front view of the wall, and FIG. 5B is a rear view of the wall. In addition, FIGS. 6 and 7 are a front view and a rear view illustrating a state before the housing is rotated, and FIG. 8 is a sectional view taken along line B-B of FIG. 7. In addition, FIGS. 9 and 10 are a front view and a rear view illustrating a state after the housing is rotated.

[Regarding Shielded Connector Structure 1]

In FIGS. 1A and 1B, a shielded connector structure 1 according to one embodiment of the invention includes: a shielded wire 2 for electrically connecting high-voltage devices mounted on a hybrid vehicle or an electric vehicle; a shielded connector 3 provided in a terminal of the shielded wire 2; and a shield case 4 (metal member) of the device. In the embodiment, it is assumed that the above-described devices are inverters, motors, and the like. Hereinafter, each constituent member will be described.

[Regarding Shielded Wire 2]

Figure 12:
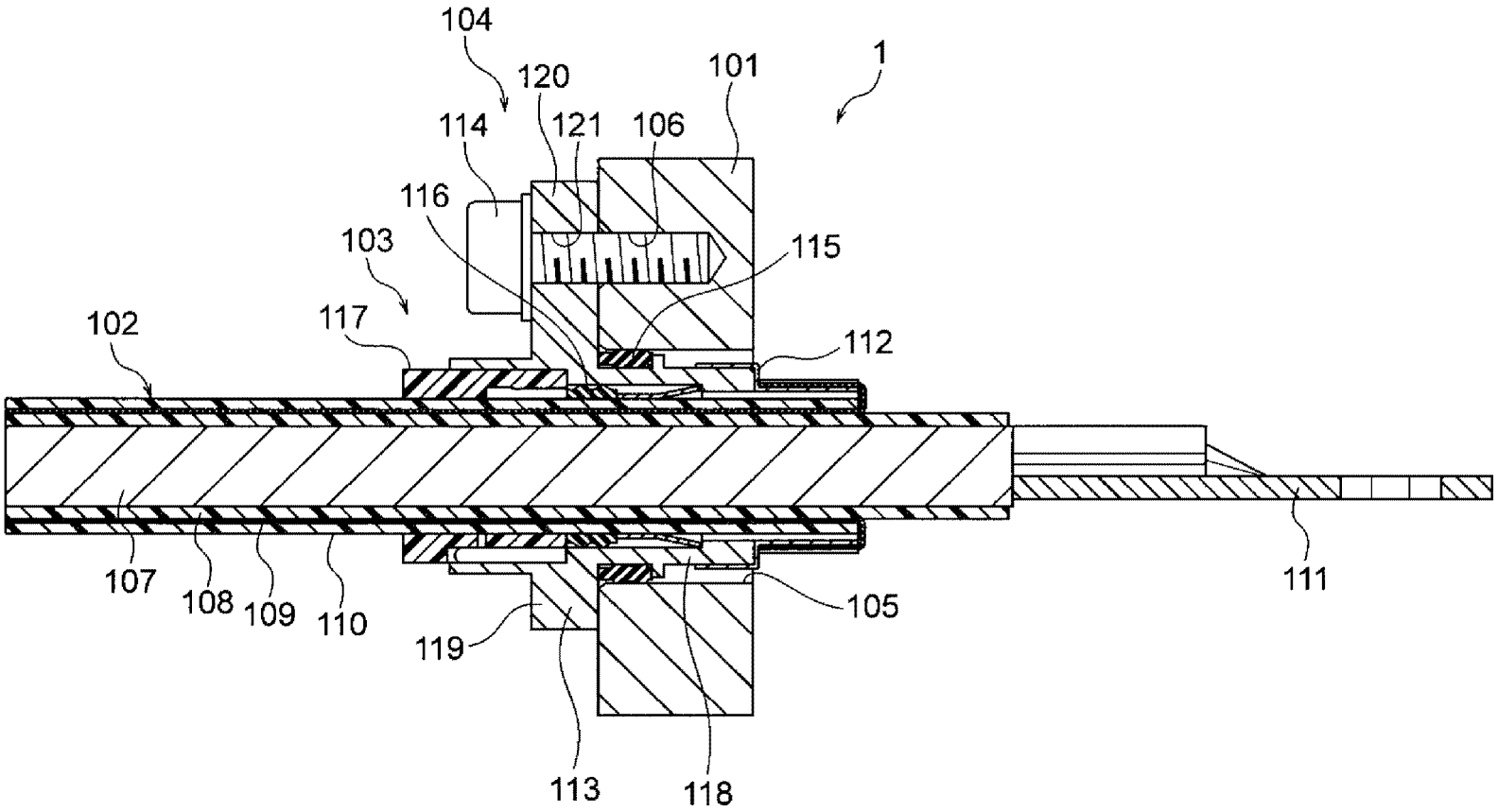
FIG. 12 is a sectional view taken along line C-C in FIG. 11A.
Figure 13:
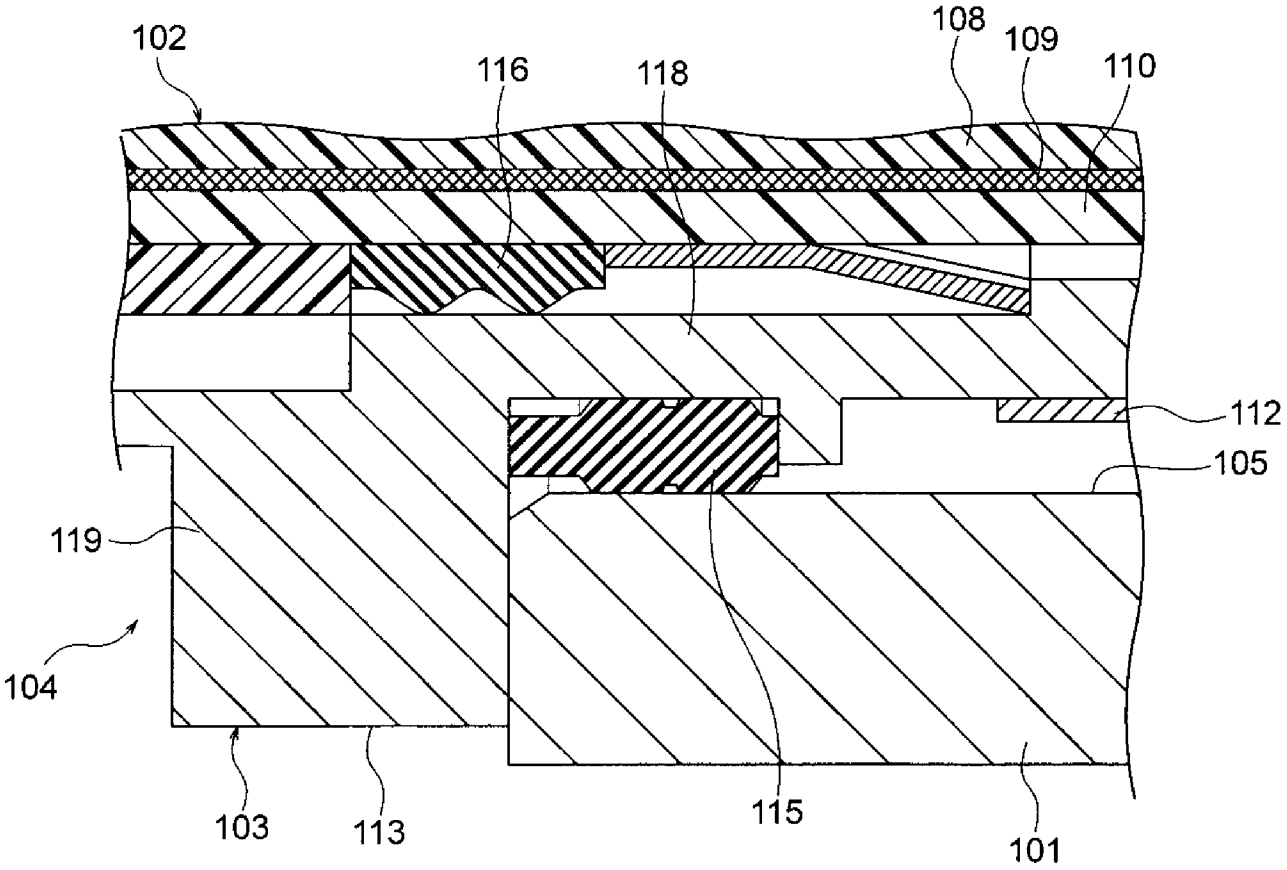
FIG. 13 is an enlarged view of a main portion of FIG. 12.

In FIGS. 1A to 2, the shielded wire 2 is the same as a shielded wire 102 (refer to FIG. 12) of the related art, and includes: a conductor 5 having a circular cross section and having conductivity; an insulator 6 having insulation properties which covers the conductor 5 with a predetermined thickness; a shield member 7 (a braid: formed in a tubular shape by braiding of an element wire having conductivity) which covers the core parts; and a sheath 8 having insulating properties which covers the outer side of the shield member 7 with a predetermined thickness.

The terminal of the shielded wire 2 is processed. Specifically, the sheath 8 is removed with a predetermined length. When the sheath 8 is removed, the shield member 7 is exposed, and the exposed shield member 7 is folded back onto the sheath 8. When the shield member 7 is folded back, the insulator 6 is exposed, and the exposed insulator 6 is removed with a predetermined length. When the insulator 6 is removed with a predetermined length, the conductor 5 is exposed. When the terminal of the shielded wire 2 is processed into the above-described state, the shielded connector 3 is assembled to the terminal part.

[Regarding Shielded Connector 3]

In FIGS. 1A to 3, the shielded connector 3 includes: a conductive terminal fitting 9 which is connected to the conductor 5 of the shielded wire 2; a conductive shield terminal 10 which is connected to the shield member 7 of the shielded wire 2 and indirectly comes into contact with a wall 27 (will be described later) of a shield case 4; a metal shield ring 11 for fixing the shield member 7 to the shield terminal 10; a conductive housing 12 into which the shielded wire 2 is inserted; a bolt 13 for fixing the housing 12 to the wall 27; a positioning member 14 for determining the position of the shielded wire 2 with respect to the housing 12; a waterproof packing 15 and a rubber plug 16 which are respectively provided on the outside and inside of the housing 12; and a resin rear holder 17 which is engaged with the rear portion of the housing 12.

Regarding the shielded connector 3, since the housing 12 has the features, hereinafter, the housing 12 will be described (other constituent members are assumed to be the same as those of the related art, and the description thereof will be omitted here).

[Regarding Housing 12]

In FIGS. 1A to 4B, the housing 12 includes a housing main body 18, an annular flange portion 19 which is integrated with the housing main body 18, and a fixing flange portion 20 which is integrated with the annular flange portion 19, and is formed in a shape illustrated in the drawing.

In FIGS. 2 to 4B, the housing main body 18 is formed in a cylindrical shape that extends in the forward-and-rearward direction. The housing main body 18 includes a main body insertion portion 21 and a main body rear portion 22. The main body insertion portion 21 is formed at a part which is inserted into the circular insertion hole 31 of the wall 27 which will be described later. In addition, in the main body insertion portion 21, an insertion part of the shielded wire 2 is formed on the inside thereof. On the inner circumferential surface of the main body insertion portion 21, a close contact surface (reference numeral thereof is omitted) with respect to the rubber plug 16, and an engagement step portion (reference numeral thereof is omitted) with respect to the positioning member 14 are formed. Meanwhile, on the outer circumferential surface of the main body insertion portion 21, a close contact surface 23 with respect to the packing 15 and an outer circumferential projected portion 24 for determining the position of the packing 15 are formed. In addition, a projection portion 25 which is a characteristic part of the shielded connector structure 1 is also formed on the outer circumferential surface of the main body insertion portion 21. The outer circumferential projected portion 24 is formed in an annular projected part which goes around the outer circumferential surface of the main body insertion portion 21.

[Regarding Projection Portion 25]

In FIGS. 3 to 4B, the projection portion 25 is formed at a projected part having a shape of a flake. The projection portion 25 is formed so as to be positioned more front side than the outer circumferential projected portion 24. The projection portion 25 is formed at a part sandwiching an inner circumferential projected portion 32 (will be described later) with the outer circumferential projected portion 24. The projection portion 25 is disposed so as to be aligned with a first axis L1 that links a main body center C1 of the housing main body 18 and a hole center C2 of the bolt insertion hole 26 which will be described later. In addition, the projection portion 25 is formed to be disposed at a position opposite to the bolt insertion hole 26 with respect to the main body center C1. The projection portion 25 is formed at a part (a part to be caught, a part to be brought into contact) engaged with the inner circumferential projected portion 32 in a case where strong impact (will be described later) is applied. The projection portion 25 is formed so that a top portion thereof is in an arc shape (formed to have an arc shape in accordance with the curvature of the circular insertion hole 31 which will be described later).

[Regarding Fixing Flange Portion 20]

In FIGS. 2 to 4B, the fixing flange portion 20 is formed at a part for bolt-fastening the housing with respect to the wall 27 (will be described later) of the shield case 4. The fixing flange portion 20 is formed at a part which protrudes in a substantially triangular shape from an edge portion of the annular flange portion 19. The circular bolt insertion hole 26 is formed to penetrate through the fixing flange portion 20. The bolt insertion hole 26 is formed at a part for inserting the bolt 13.

[Regarding Shield Case 4 (Metal Member) of Device]

In FIGS. 1A to 5, the shield case 4 of the device includes the conductive wall 27. On the wall 27, both of one surface 28 and the other surface 29 are formed to be flat. On the wall 27, a female screw portion 30 serving as a screwing part of the bolt 13 and a circular insertion hole 31 serving as an insertion part of the housing main body 18. The female screw portion 30 is formed to be disposed in the vicinity of the circular insertion hole 31.

[Regarding Circular Insertion Hole 31]

In FIGS. 2 to 5, the circular insertion hole 31 is formed to circularly penetrate through the wall 27. The circular insertion hole 31 has the inner circumferential projected portion 32 and a cutout portion 33. The inner circumferential projected portion 32 and the cutout portion 33 are characteristic parts of the shielded connector structure 1.

[Regarding Inner Circumferential Projected Portion 32 and Cutout Portion 33]

In FIGS. 2 to 5, the inner circumferential projected portion 32 is formed at a projected part that extends in the inner circumferential direction of the circular insertion hole 31. In addition, the cutout portion 33 is formed at a part having a shape that divides a part of the inner circumferential projected portion 32. The inner circumferential projected portion 32 and the cutout portion 33 are formed in a C-shaped rib in a state where the circular insertion hole 31 is viewed from the front. The cutout portion 33 (the divided part of the inner circumferential projected portion 32) is disposed to be aligned with a third axis L3 which intersects with a second axis L2 which links the center C3 of the circular insertion hole 31 and the center C4 of the female screw portion 30.

[Regarding First Assembling Process of Shielded Connector 3 and Wall 27]

When the main body insertion portion 21 is inserted into the circular insertion hole 31 by aligning the position of the projection portion 25 with the position of the cutout portion 33, the state illustrated in FIGS. 6 and 7 is obtained. In the first assembling process, when the shielded connector 3 is inclined in a state where the first axis L1 is aligned with the third axis L3, the position of the projection portion 25 is aligned with the position of the cutout portion 33, and at this time, the shielded connector 3 is in a state of being capable of inserting the main body insertion portion 21 into the circular insertion hole 31. At this state, when the shielded connector 3 is pushed in, the first assembling process is completed. In other words, the insertion of the main body insertion portion 21 is completed. Furthermore, in a state where the first axis L1 is not aligned with the third axis L3, the fixing flange portion 20 or the annular flange portion 19 is separated from the one surface 28 of the wall 27, and thus, an operator can immediately recognize that the insertion is not completed (when the insertion is not completed, by rotating the housing slightly to the left and right, the projection portion 25 falls into the cutout portion 33, and accordingly, the insertion of the main body insertion portion 21 is completed).

[Regarding Second Assembling Process of Shielded Connector 3 and Wall 27]

In the second assembling process, when the housing 12 is rotated in the direction of the arrow in FIG. 6, at the position at which the first axis L1 is aligned with the second axis L2, as illustrated in FIG. 9, the bolt insertion hole 26 is aligned with the female screw portion 30 and the second assembling process is completed. When the housing 12 is rotated as described above, the projection portion 25 is engaged with the inner circumferential projected portion 32 as illustrated in FIGS. 10 and 3.

[Regarding Third Assembling Process of Shielded Connector 3 and Wall 27]

In the third assembling process, when the bolt 13 is inserted through the bolt insertion hole 26 aligned with the female screw portion 30 and tightened, as illustrated in FIGS. 1A to 2, the shielded connector 3 is fixed to the wall 27 and a series of the processes is completed. Accordingly, the shielded connector structure 1 is formed.

[Regarding Case where Strong Impact is Applied to Shielded Connector Structure 1]

In FIG. 3, in the shielded connector structure 1, since the projection portion 25 is in a state of being engaged with the inner circumferential projected portion 32, even when strong impact is applied to a location pointed by the arrow W for some reasons, a gap (floating or the like) which affects the shielding performance is hardly generated between the annular flange portion 19 and the wall 27.

[Regarding Effects of Shielded Connector Structure 1]

Above, as described with reference to FIGS. 1A to 10, according to the shielded connector structure 1 which is an embodiment of the invention, for some reasons, even when strong impact is applied to the side opposite to the fastening point (the location indicated by the arrow W), since the projection portion 25 of the housing 12 in the shielded connector 3 is engaged with the inner circumferential projected portion 32 of the shield case 4, the shielded connector 3 can be excellently fixed with respect to the shield case 4. In other words, it is possible to prevent generation of a gap on the side opposite to the fastening point.

In addition, according to the shielded connector structure 1 of the embodiment of the invention, since the main body insertion portion 21 is inserted into the circular insertion hole 31 by aligning the position of the projection portion 25 with the position of the cutout portion 33, and the projection portion 25 is engaged with the inner circumferential projected portion 32 only by rotating the housing 12 after this, it is also possible to ensure excellent workability.

Further, according to the shielded connector structure 1 of the embodiment of the invention, since the third axis L3 is set so as to intersect with the second axis L2 at an acute angle, it is possible to reduce the rotation amount of the housing 12, and thereby contributing to ensuring excellent workability.

It is needless to say that the invention can be variously modified within a range not changing the gist of the invention.

What is claimed is:

1. A shielded connector structure comprising:

a shielded wire for connecting a device;

a shielded connector provided on the shielded wire; and a metal member provided on the device, wherein the shielded connector includes a terminal fitting which is connected to a conductor of the shielded wire, a shield terminal which is connected to a shield member of the shielded wire and directly or indirectly comes into contact with the metal member, a housing into which the shielded wire is inserted, and a bolt for fixing the housing to the metal member;

wherein the metal member includes a circular insertion hole and a female screw portion which is disposed in a vicinity of the circular insertion hole;

wherein the circular insertion hole includes an inner circumferential projected portion extending in an inner circumferential direction from an inner surface of the circular insertion hole and a cutout portion that divides a part of the inner circumferential projected portion;

wherein the housing includes a cylindrical housing main body and a fixing flange portion having a bolt insertion hole and which is integrated with the housing main body;

wherein the housing main body includes a main body insertion portion configured to be inserted into the circular insertion hole and a projection portion which protrudes from an outer circumferential surface of the main body insertion portion and is engageable with the inner circumferential projected portion in the circular insertion hole;

wherein the projection portion is disposed so as to be aligned with a first axis that links a main body center of the housing main body and a hole center of the bolt insertion hole, and is disposed so that the main body center is arranged between the bolt insertion hole and the projection portion; and wherein the cutout portion is disposed so as to be aligned with a third axis intersecting with a second axis that links a center of the circular insertion hole and a center of the female screw portion.

2. The shielded connector structure according to claim 1, wherein the third axis intersects with the second axis at an acute angle.

3. The shielded connector structure according to claim 1, wherein the inner circumferential projected portion is formed in a C-shaped rib in a state where the circular insertion hole is viewed from a front side.

4. The shielded connector structure according to claim 1, wherein a close contact surface and an outer circumferential projected portion are formed on the outer circumferential surface of the main body insertion portion;

wherein a packing is attached on the close contact surface; and wherein the outer circumferential projected portion positions the packing.

* * * * *